US010006691B2

(12) United States Patent
Jung

(10) Patent No.: US 10,006,691 B2
(45) Date of Patent: Jun. 26, 2018

(54) REFRIGERATOR

(71) Applicant: SAMSUNG ELECTRONICS CO., LTD., Suwon-si, Gyeonggi-do (KR)

(72) Inventor: Moon Gyo Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days. days.

(21) Appl. No.: 15/488,036

(22) Filed: Apr. 14, 2017

(65) Prior Publication Data

US 2017/0356685 A1 Dec. 14, 2017

(30) Foreign Application Priority Data

Jun. 8, 2016 (KR) ..... 10-2016-0070666

(51) Int. Cl.

| | |
|---|---|
| ***F25D 23/00*** | (2006.01) |
| ***F25D 23/02*** | (2006.01) |
| ***E05B 65/00*** | (2006.01) |
| ***E05C 7/02*** | (2006.01) |
| ***E05D 3/02*** | (2006.01) |
| ***E05D 11/10*** | (2006.01) |

(Continued)

(52) U.S. Cl.

CPC ..... *F25D 23/028* (2013.01); *E05B 65/0042* (2013.01); *E05C 7/02* (2013.01); *E05D 3/02* (2013.01); *E05D 7/06* (2013.01); *E05D 11/1014* (2013.01); *E05F 3/20* (2013.01); *F25D 23/025* (2013.01); *E05Y 2900/31* (2013.01); *F25D 2323/024* (2013.01)

(58) Field of Classification Search

CPC .. F25D 23/025; F25D 23/28; F25D 2323/023; F25D 2323/024; E05C 7/02; E05Y 2900/31

See application file for complete search history.

(56) References Cited

U.S. PATENT DOCUMENTS

2014/0232251 A1* 8/2014 Kim ..... F25D 23/028 312/404
2015/0137674 A1* 5/2015 Choi ..... F25D 23/04 312/404

(Continued)

FOREIGN PATENT DOCUMENTS

CN 105696874 A 6/2016
EP 2770283 A2 8/2014

(Continued)

OTHER PUBLICATIONS

Extended European Search Report dated Oct. 10, 2017 in corresponding European Patent Application No. 17172225.9.

*Primary Examiner* — Daniel J Rohrhoff
(74) *Attorney, Agent, or Firm* — Staas & Halsey LLP

(57) ABSTRACT

Disclosed herein is a refrigerator. The refrigerator includes a body provided with a storage compartment, a door unit provided with a first door provided with an opening and rotatably coupled to the body, and a second door configured to open or close the opening and provided in front of the first door, a latch unit provided in the door unit and configured to selectively fix the second door to the first door each other, and a first hinge unit provided in the body to support a rotation of the first door and provided with a push portion configured to selectively operate the latch unit according to the rotation of the first door.

18 Claims, 11 Drawing Sheets

(51) Int. Cl.
*E05F 3/20* (2006.01)
*E05D 7/06* (2006.01)

(56) References Cited

U.S. PATENT DOCUMENTS

| | | | | |
|---|---|---|---|---|
| 2015/0260445 | A1* | 9/2015 | Kim | F25D 23/028 312/405 |
| 2016/0222710 | A1* | 8/2016 | Kang | F25D 23/025 |
| 2017/0176086 | A1* | 6/2017 | Kang | E05C 19/163 |
| 2017/0188721 | A1* | 7/2017 | Park | F21V 29/89 |
| 2017/0191741 | A1* | 7/2017 | Jung | F25D 23/04 |
| 2017/0211874 | A1* | 7/2017 | Kim | F25D 23/025 |
| 2017/0284730 | A1* | 10/2017 | Yoo | F25D 25/025 |
| 2017/0299255 | A1* | 10/2017 | Kim | F25D 25/025 |

FOREIGN PATENT DOCUMENTS

| | | | |
|---|---|---|---|
| EP | 2770284 | A2 | 8/2014 |
| EP | 2770283 | A3 | 6/2015 |
| EP | 2770284 | A3 | 7/2015 |
| EP | 2921805 | A1 | 9/2015 |
| KR | 10-2013-0015989 | | 2/2013 |
| KR | 10-2013-0030111 | | 3/2013 |
| KR | 10-2014-0104638 | | 8/2014 |
| KR | 10-2015-0056955 | | 5/2015 |
| WO | 2014/200316 | A1 | 12/2014 |

* cited by examiner

REFRIGERATOR

CROSS-REFERENCE TO RELATED APPLICATIONS

This application claims the benefit of Korean Patent Application No. 10-2016-0070666, filed on Jun. 8, 2016 in the Korean Intellectual Property Office, the disclosure of which is incorporated herein by reference.

BACKGROUND

1. Field

Embodiments of the present disclosure relate to a refrigerator, more particularly to a refrigerator having a double door.

2. Description of the Related Art

A refrigerator is an appliance to keep food fresh by including a body having a storage compartment, and a cold air supply system to supply cold air to the storage compartment. The storage compartment includes a refrigerating compartment kept at a temperature of approximately 0° C.~5° C., to store food in a refrigerated state and a freezing compartment kept at a temperature of approximately −30 C~0° C., to store food in a frozen state.

The storage compartment is equipped with a shelf, so food can be placed. The storage compartment may be provided such a front surface thereof is opened so that food is inserted thereinto and withdrawn therefrom. The opened front surface of the storage compartment may be opened and closed by a first door rotatably coupled to the body. A door pocket storing food may be provided on the rear surface of the first door, wherein the door pocket is separated from the shelf disposed in the storage compartment.

Since the door pockets are provided on the rear surface of the first door, it may be possible to access the door pocket by opening the first door. Alternatively, there is a refrigerator in which a separate second door is provided in a first door, to access a door pocket without opening the first door. As for the refrigerator having the second door, it may be possible to approach the door pocket provided on the rear side of the door by only opening the second door without opening the door, and thus the variety of food storage can be improved and the effect of preserving the cold air can be obtained.

However, when the first door and the second door are opened together, the first door and the second door are separated from each other and it causes the inconvenient to use, and the damage of the first door and the second door.

SUMMARY

Therefore, it is an aspect of the present disclosure to provide a refrigerator capable of fixing a first door and a second door to each other so that the first door and the second door are not separated from each other when the first door and the second door are opened together.

It is another aspect of the present disclosure to provide a refrigerator capable of securing the safety of use by preventing a first door and a second door from being separated when the first door and the second door are opened together.

It is another aspect of the present disclosure to provide a refrigerator capable of selectively fixing and releasing the fixation of a first door and a second door by using a relatively simple configuration.

It is another aspect of the present disclosure to provide a refrigerator capable of maximizing the space utilization by disposing a latch unit in a dead space that is adjacent to a hinge unit, and capable of maintaining a high level of appearance quality without a separate cover covering the latch unit.

Additional aspects of the disclosure will be set forth in part in the description which follows and, in part, will be obvious from the description, or may be learned by practice of the disclosure.

In accordance with one aspect of the present disclosure, a refrigerator includes a body provided with a storage compartment, a door unit provided with a first door provided with an opening and rotatably coupled to the body, and a second door configured to open or close the opening and provided in front of the first door, a latch unit provided in the door unit and configured to selectively fix the second door to the first door each other, and a first hinge unit provided in the body to support a rotation of the first door and provided with a push portion configured to selectively operate the latch unit according to the rotation of the first door.

The latch unit may connect and fix the second door to the first door each other when the first door opens the storage compartment, and may release the connection between the first door and the second door when the first door closes the storage compartment.

The latch unit may include a latch lever rotatably coupled to the first door, and a torsion member configured to apply a torque to the latch lever so that the latch lever rotates in a direction to which the latch lever is connected to the second door.

The latch lever may include a rotation portion rotatably coupled to the first door, a first connecting portion configured to extend from the rotation portion in a first direction and selectively connected to the second door, and a power transmission part configured to extend from the rotation portion to a second direction that is different from the first direction, and selectively pressed by the push portion.

One end portion of the torsion member may be fixed to the first door and the other end thereof, which is opposite to the one end, may be fixed to the power transmission part.

The second door may include a second connecting portion provided on a rear surface thereof and configured to be selectively connected to the first connecting portion.

The second connecting portion may be detachably provided in the second door.

The latch unit may further include a latch bracket configured to rotatably fix the latch lever to the first door.

The latch unit may be provided in the first door.

The push portion may be detachably provided in the first hinge unit.

The refrigerator may further include a second hinge unit provided in the first door to guide a rotation of the second door.

The first door may include an auto close lever having one end portion thereof fixed to the first door and having the elasticity, and a roller rotatably installed in the other end portion that is opposite to the one end portion of the auto close lever.

The push portion may selectively make contact with the roller and press the roller to a direction in which the first door is closed, when the first door is closed.

When the first door is closed, the push portion may push and rotate the latch unit to release the connection between the first door and the second door while pressing the roller.

When the first door is closed, the push portion may include a first push surface pressing the roller, and a second push surface pushing and rotating the latch unit.

In accordance with another aspect of the present disclosure, a refrigerator include a body provided with a storage compartment, a first door provided with an opening and configured to open or close the storage compartment and rotatably coupled to the body, a second door configured to open or close the opening and rotatably provided in the same direction as the first door, a latch unit provided in the first door and configured to selectively fix the second door to the first door each other, a first hinge unit provided in the body to rotatably support the first door and configured to selectively operate the latch unit according to a rotation of the first door, and an automatic closing device provided in the first door and configured to be pressed by the first hinge unit in a direction in which the first door is closed, when the first door is closed by a predetermined angle, wherein the first hinge unit is disposed to be apart from the latch unit and the automatic closing device when the first door opens the storage compartment, and disposed to apply the force to the latch unit and the automatic closing device by making contact with the latch unit and the automatic closing device when the first door closes the storage compartment.

The latch unit may include a latch lever rotatably coupled to the first door, and a torsion member configured to apply a torque to the latch lever so that the latch lever rotates in a direction to which the latch lever is connected to the second door, wherein the torque of the torsion member may be set to be smaller than a force received by the latch lever from the first hinge unit when the latch lever and the first hinge unit are in contact with each other.

The latch lever may include a power transmission part configured to be selectively pressed by the first hinge unit, wherein the first hinge unit may include a push portion having a first push surface selectively in contact with the power transmission part and a second push surface selectively in contact with the automatic closing device.

The automatic closing device may include an auto close lever having one end portion thereof fixed to the first door and having the elasticity; and a roller rotatably installed on the other end portion of the automatic closing device that is opposite to the one end portion of the automatic closing device, wherein the roller may be selectively in contact with one part of the first hinge unit.

In accordance with still another aspect of the present disclosure, a refrigerator include a body provided with a storage compartment, a first door provided with an opening and configured to open or close the storage compartment and rotatably coupled to the body, a second door configured to open or close the opening and rotatably coupled to the first door, a latch unit provided in the first door and configured to selectively fix the second door to the first door each other, a hinge unit provided in the body to guide a rotation of the first door, and a push member disposed adjacent to the first hinge unit and configured to selectively operate the latch unit according to a rotation of the first door.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
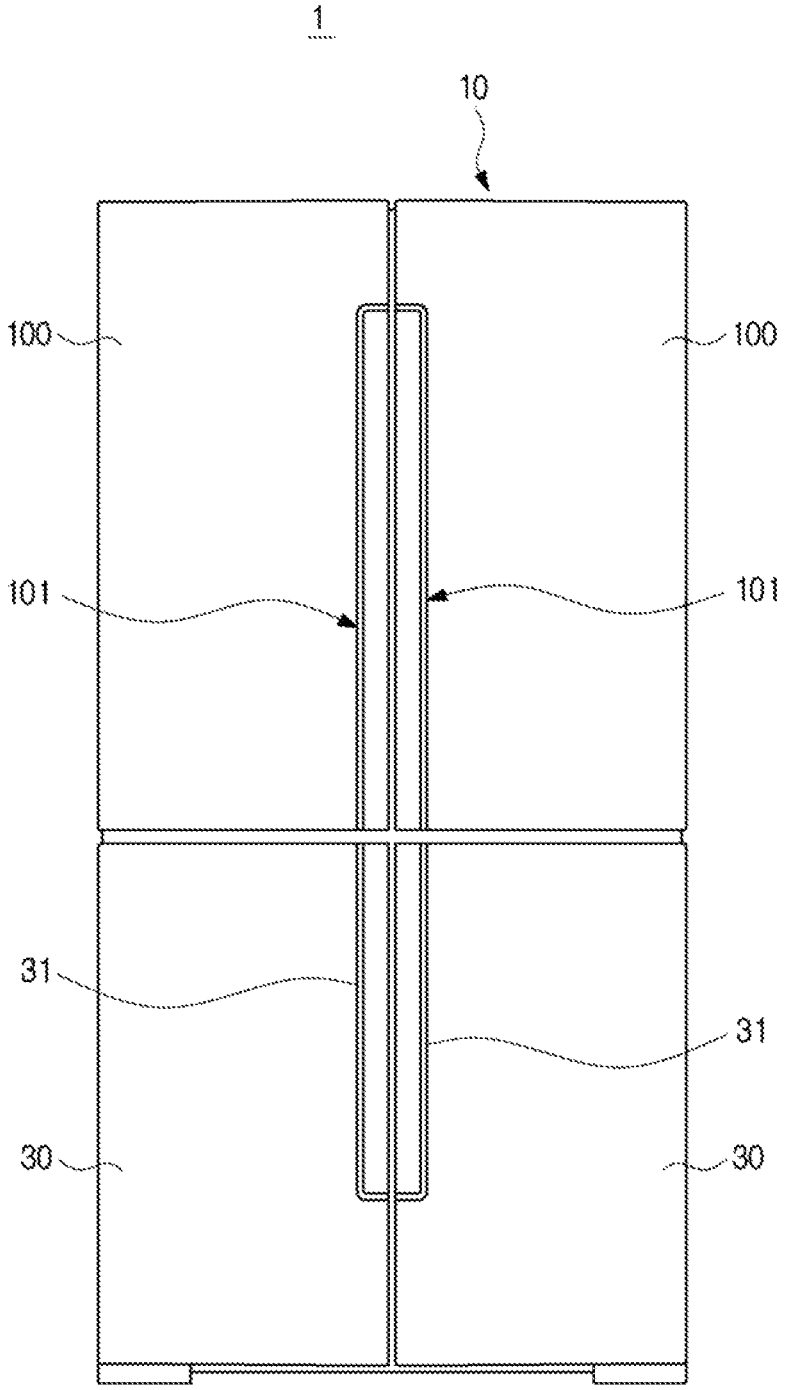
FIG. 1 is a view illustrating a front surface of a refrigerator in accordance with one embodiment of the present disclosure, more particularly a view illustrating a case in which both of a first door and a second door are closed.

Embodiments described in the present disclosure and configurations shown in the drawings are merely examples of the embodiments of the present disclosure, and may be modified in various different ways at the time of filing of the present application to replace the embodiments and drawings of the present disclosure.

In addition, the same reference numerals or symbols shown in the drawings of the present disclosure indicate elements or components performing substantially the same function.

Also, the terms used herein are used to describe the embodiments and are not intended to limit and/or restrict the present disclosure. The singular forms "a," "an" and "the" are intended to include the plural forms as well, unless the context clearly indicates otherwise. In this present disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the present disclosure, a first element may be termed as a second element, and a second element may be termed as a first element. The term of "and/or" includes a plurality of combinations of relevant items or any one item among a plurality of relevant items.

In the following detailed description, the terms of "front end", "rear end", "upper portion", "lower portion", "upper end", "lower end" and the like may be defined by the drawings, but the shape and the location of the component is not limited by the term.

The present disclosure will be described more fully hereinafter with reference to the accompanying drawings.

Figure 2:
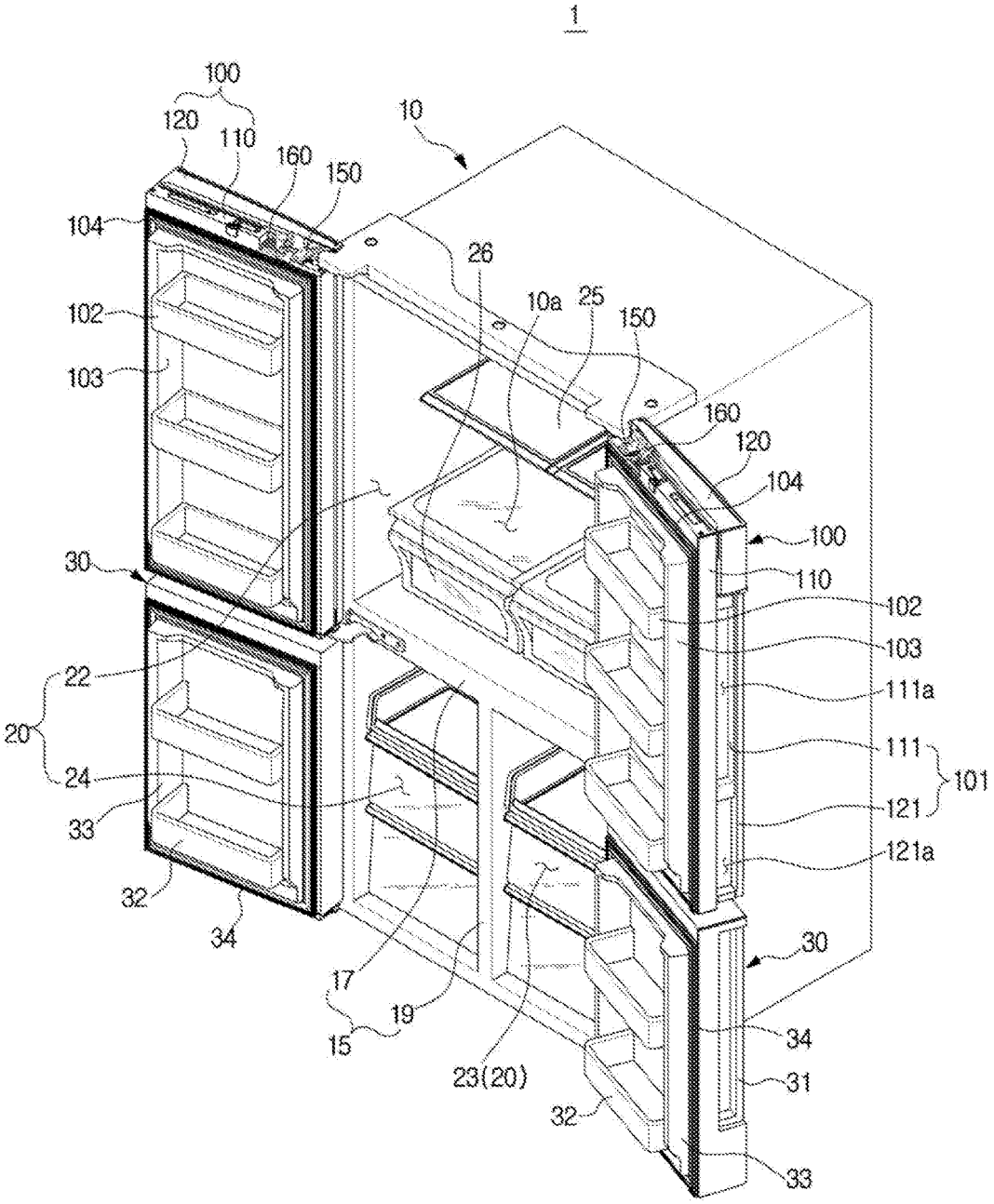
FIG. 2 is a view illustrating a case in which both of the first door and the second door of the refrigerator are opened.
Figure 3:
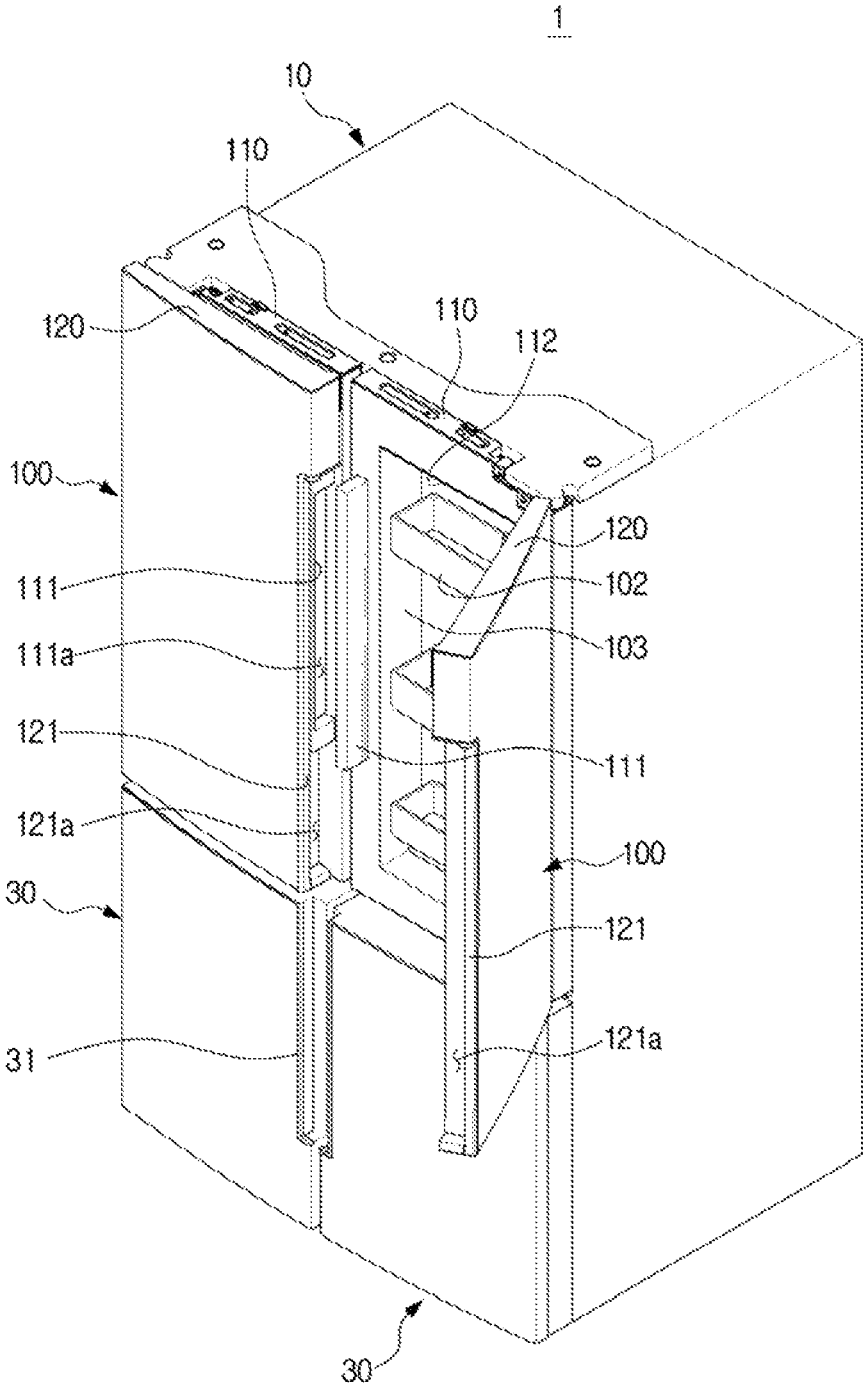
FIG. 3 is a view illustrating a case in which one second door of the second doors of the refrigerator of FIG. 1 are opened.

FIG. 1 is a view illustrating a front surface of a refrigerator 1 in accordance with one embodiment of the present disclosure, more particularly a view illustrating a case in which both of a first door 110 and a second door 120 are closed. FIG. 2 is a view illustrating a case in which both of the first door 110 and the second door 120 of the refrigerator 1 are opened. FIG. 3 is a view illustrating a case in which one second door 120 of the second doors 120 of the refrigerator 1 of FIG. 1 are opened.

The refrigerator 1 may include a body 10, a storage compartment 20 formed in the body 10 so as to be divided into an upper portion and a lower portion, a door configured to open and close the storage compartment 20, and a cold air supply device (not shown) configured to supply cold air to the storage compartment 20.

The body 10 may include an inner case forming the storage compartment 20, an outer case coupled to the outside of the inner case to form an appearance, and an insulation material foamed between the inner case and the outer case to insulate the storage compartment 20.

The cold air supply device may generate cold air using a cooling cycle that compresses, condenses, expands, and evaporates the refrigerant.

The storage compartment 20 may be divided into a plurality of spaces by a partition 15 and a plurality of shelves 25 and a plurality of storage containers 26 may be provided in the storage compartment 20 to store food and the like.

The storage compartment 20 may be divided into a plurality of storage compartments 22, 23 and 24 by the partition 15. The partition 15 may include a first partition 17 horizontally coupled to the inside of the storage compartment 20 to divide the storage compartment 20 into an upper storage compartment 22 and a lower compartment 23 and 24, and a second partition 19 vertically coupled to the lower compartment 23 and 24 to divide the lower compartment 23 and 24 into a first storage compartment 23 and a second storage compartment 24.

The partition 15, which has a "T" shape since the first partition 17 and the second partition 19 are coupled to each other, may divide the storage compartment 20 into three spaces. Among the upper storage compartment 22 and the lower compartment 23 and 24 which are divided by the first partition 17, the upper storage compartment 22 may be used as a refrigerating compartment and the lower compartment 23 and 24 may be used as a freezing compartment.

The entire of the lower compartment 23 and 24 may be used as a freezing compartment, alternatively, the first storage compartment 23 may be used a freezing compartment and the second storage compartment 24 may be used as both of a freezing compartment and a refrigerating compartment.

The division of the storage compartment 20 as described above is one example, and each storage compartment 22, 23, and 24 may be used differently from the above configuration.

The refrigerating compartment 22 may be opened and closed by a pair of door units 100 rotatably coupled to the body 10. The pair of door units 100 may be opened and closed through a pair of refrigerating compartment door unit handles 101 including a first door handle 111 or a second door handle 121, respectively. The rotation operation of the pair of door units 100 will be described later in detail.

The freezing compartment 24 may be opened and closed by a pair of freezing compartment door units 30 rotatably coupled to the body 10. The pair of freezing compartment door units 30 may be opened and closed through a pair of freezing compartment door unit handles 31. A sliding door may be applied to a door configured to open and close the freezing compartment 24.

The pair of door units 100 and the pair of freezing compartment doors 30 may open and close a body opening 10*a* of the opened body 10. Door shelves 102 and 32 storing food may be provided on rear surfaces of the pair of door units 100 and the pair of freezing compartment doors 30, respectively.

Each of the door shelves 102 and 32 may include a shelf support portion 103 and 33 extending vertically from each door unit 100 to support the respective door shelf 102 from the left and right sides of the respective door shelf 102 and 32. The shelf support portions 103 and 33 may be detachably provided to the respective door units 100 and 30 in a separate structure and according to the embodiment, the shelf support portions 103 and 33 may extend from the respective door units 100 and 30.

First gaskets 104 and 34 may be formed on an edge of each rear surface of the door units 100 and 30 to seal a gap with the body 10 when the door units 100 and 30 are closed. The first gaskets 104 and 34 may be installed in the form of a loop along the edge of the rear surface of the door units 100 and 30, and may include magnets (not shown) provided therein.

The pair of door units 100 opening and closing the refrigerating compartment 22 may be arranged on the left and right. Hereinafter for the convenience of the description, the door unit 100 disposed on the left side of the drawing will be described as an example and the door unit 100 disposed on the left side of the drawing will be referred to as a door unit 100. However, the door unit 100 described below is not limited to the door unit 100 disposed on the left side of the drawing. Therefore, the door unit 100 described below may also be applied to the door unit 100 disposed on the right side of the drawings and at least one of the pair of freezing compartment doors 30.

The door unit 100 may be provided as a double door including the first door 110 and the second door 120.

The first door 110 may be rotatably connected to the body 10 by a first hinge unit 130 and may open and close the body opening 10*a* of the body 10. The above mentioned door shelf 102, shelf support portion 103, and first gasket 104 may be provided on the first door 110.

The first door 110 may include the first door handle 111 formed to allow a user to grip the first door 110 when the user opens and closes the first door 110. The first door handle 111 may be provided at the other end portion that is opposite to one end portion of the first door 110 connected to the first hinge unit 130. The first door handle 111 may be inserted into the inside of a second handle space 121*a* formed by the second door handle 121 described later. The first door handle 111 may form a first handle space 111*a* and a user may grip the first door handle 111 through the first handle space 111*a* to open and close the first door 110. When a user opens the door unit 100 using the first door handle 111, the second door 120, which will be described later, may be opened, as well as the first door 110.

The first door 110 may include a first door opening 112 formed to allow a user to approach the door shelf 102 and insert or withdraw food in a state in which the first door 110 is closed. The first door opening 112 may be formed to pass through the first door 110 and may be opened and closed by the second door 120, described later.

The first door 110 may include the first hinge unit 130 installed in the body 10 and configured to guide a rotation of the first door 110 by rotatably supporting the first door 110, a latch unit 140 selectively connected to the second door 120, a second hinge unit 150 configured to guide a rotation of the second door 120 by rotatably supporting the second door 120, and an automatic closing device 160 configured to allow the first door 110 to completely close the storage compartment 20 by pressing the first door 110 to the body 10 when the first door 110 is closed by a predetermined angle. The first hinge unit 130, the latch unit 140, the second hinge unit 150, and the automatic closing device 160 will be described later in detail.

The second door 120 may be provided in front of the first door 110 to open and close the first door opening 112 of the first door 110 and configured to be rotatable in the same direction as the first door 110. According to the embodiment of FIG. 2, it is illustrated that the second door 120 is rotatably supported by the second hinge unit 150 installed on the first door 110 and thus rotatable with respect to the first door 110, but is not limited thereto. The second door 120 may be provided to be rotatable with respect to the body 10 since the second hinge unit 150 is installed in the body 10.

The second door 120 may include the second door handle 121 formed to allow a user to grip the second door 120 when the user opens and closes the second door 120. The second door handle 121 may be provided at the other end portion that is opposite of one end portion of the second door 120 connected to the second hinge unit 150. The second door handle 121 may be formed to be bigger than the size of the first door handle 111 so that the first door handle 111 is inserted thereinto. The second door handle 121 may form a second handle space 121*a* and thus a user may grip the second door handle 121 through the second handle space 121*a* to open and close the second door 120. When a user opens the door unit 100 is opened through the second door handle 121, only the second door 120 may be opened without opening the first door 110.

The second door 120 may include a second gasket 122 (refer to FIG. 4) to maintain the airtightness with the first door 110. The second gasket 122 may be installed in a loop shape along the edge of the rear surface of the second door 120, and may include a magnet (not shown) provided therein.

The second door 120 may include a second connecting portion 123 (refer to FIG. 4) selectively connected and fixed to a first connecting portion 143 of the latch unit 140, which will be described later. A description thereof will be described later.

The second door 120 may include a second hinge hole 124 (refer to FIG. 4) to which the second hinge unit 150 is rotatably connected. Particularly, a second rotating shaft 151 of the second hinge unit 150 may be rotatably inserted into the second hinge hole 124. According to this configuration, the second door 120 may rotate about the first door 110 with the second rotating shaft 151 as a rotation axis.

The second door 120 may include an insertion space 125 into which a part of the second hinge unit 150 is inserted when the second door 120 is closed, so that the second hinge unit 150 is prevented from interfering with the rotation of the second door 120. The second hinge hole 124 may be formed in the insertion space 125.

Figure 4:
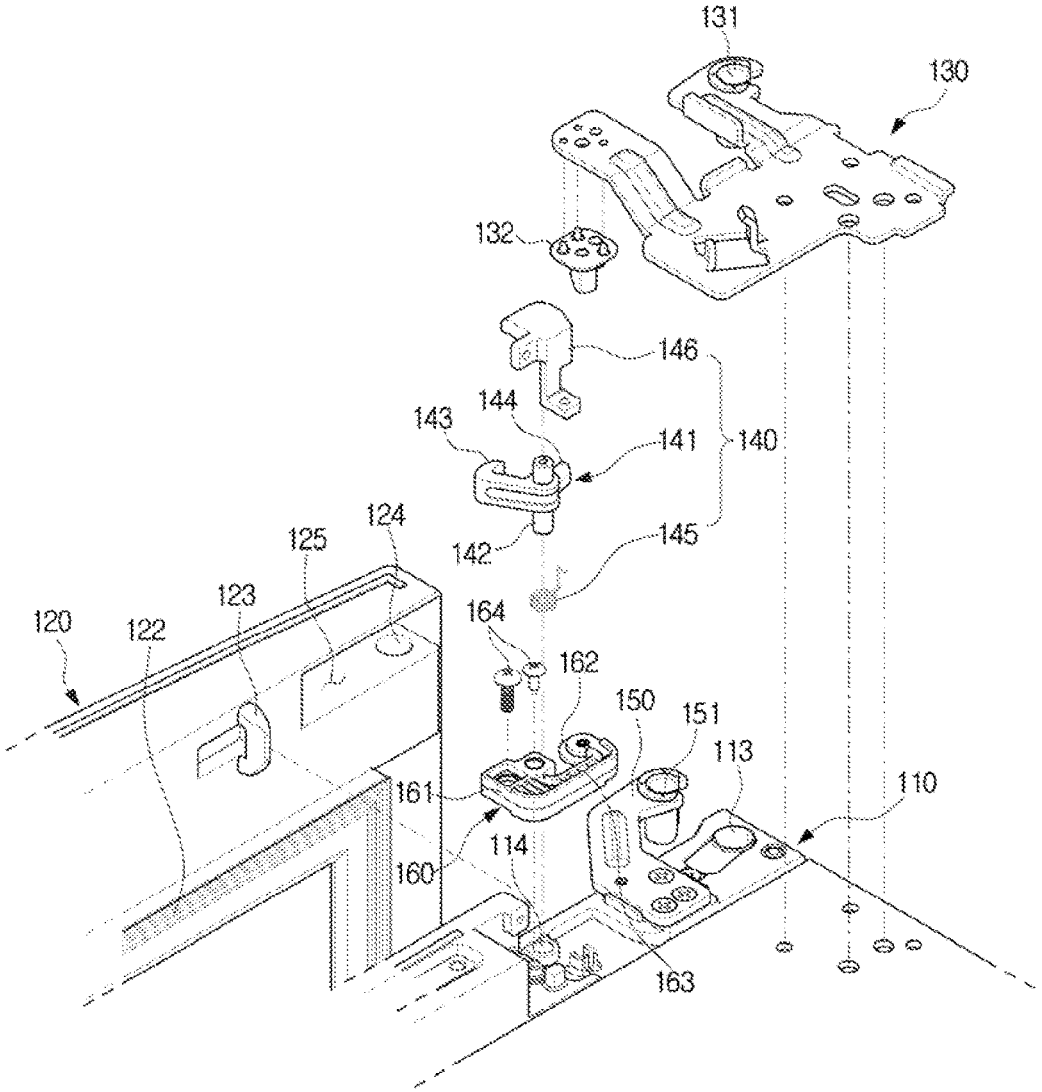
FIG. 4 is an exploded perspective view illustrating a latch unit and a hinge unit in accordance with the embodiment of the present disclosure.
Figure 5:
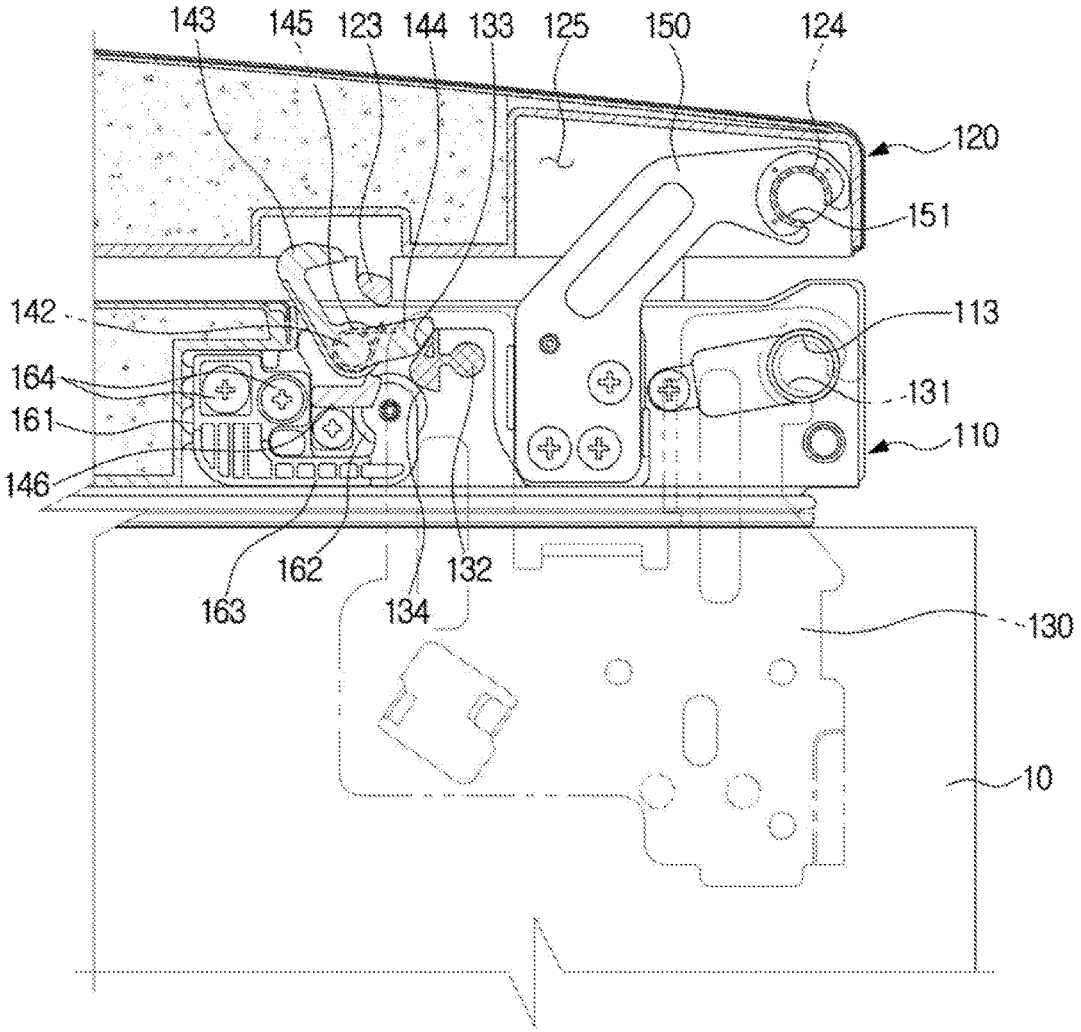
FIG. 5 is a view illustrating a state of the latch unit and the hinge unit when the first door and the second door of the refrigerator are closed in accordance with the embodiment of the present disclosure.
Figure 6:
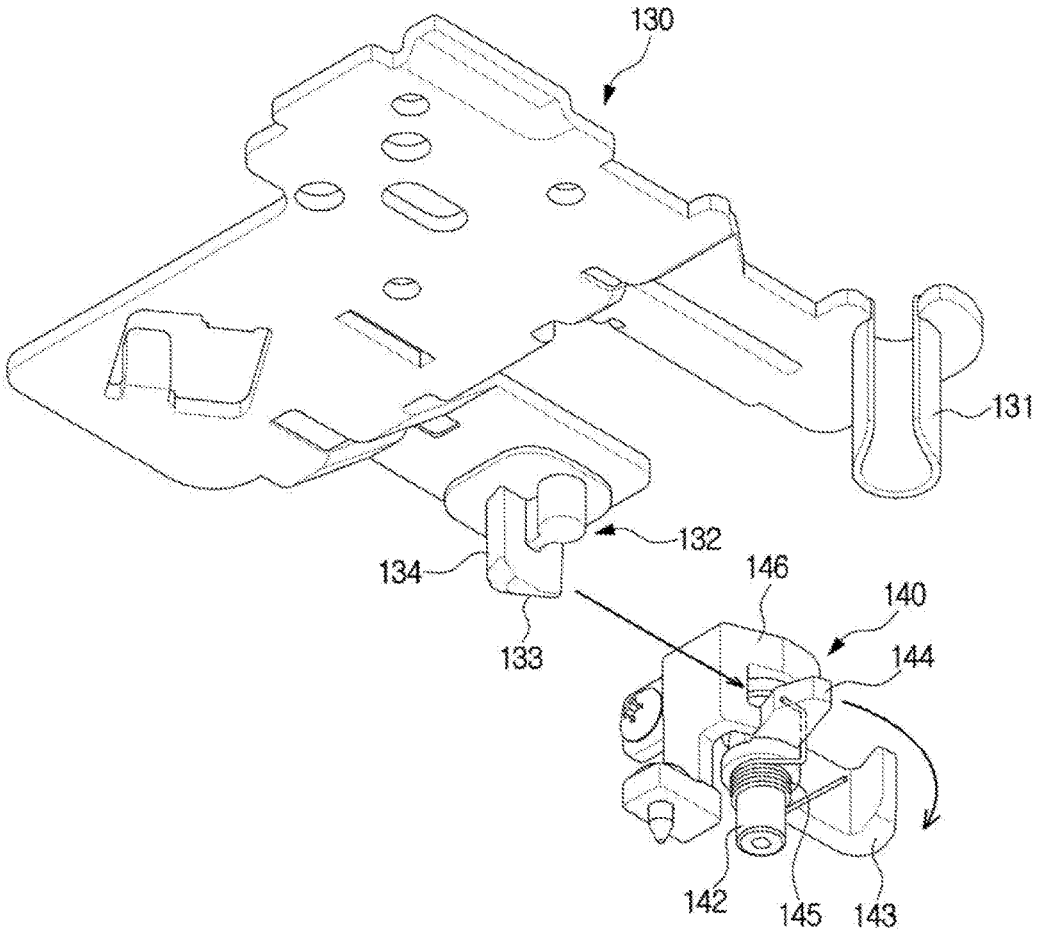
FIG. 6 is a perspective view illustrating the arrangement relationship between the first hinge unit and the latch unit in accordance with the embodiment of the present disclosure.
Figure 7:
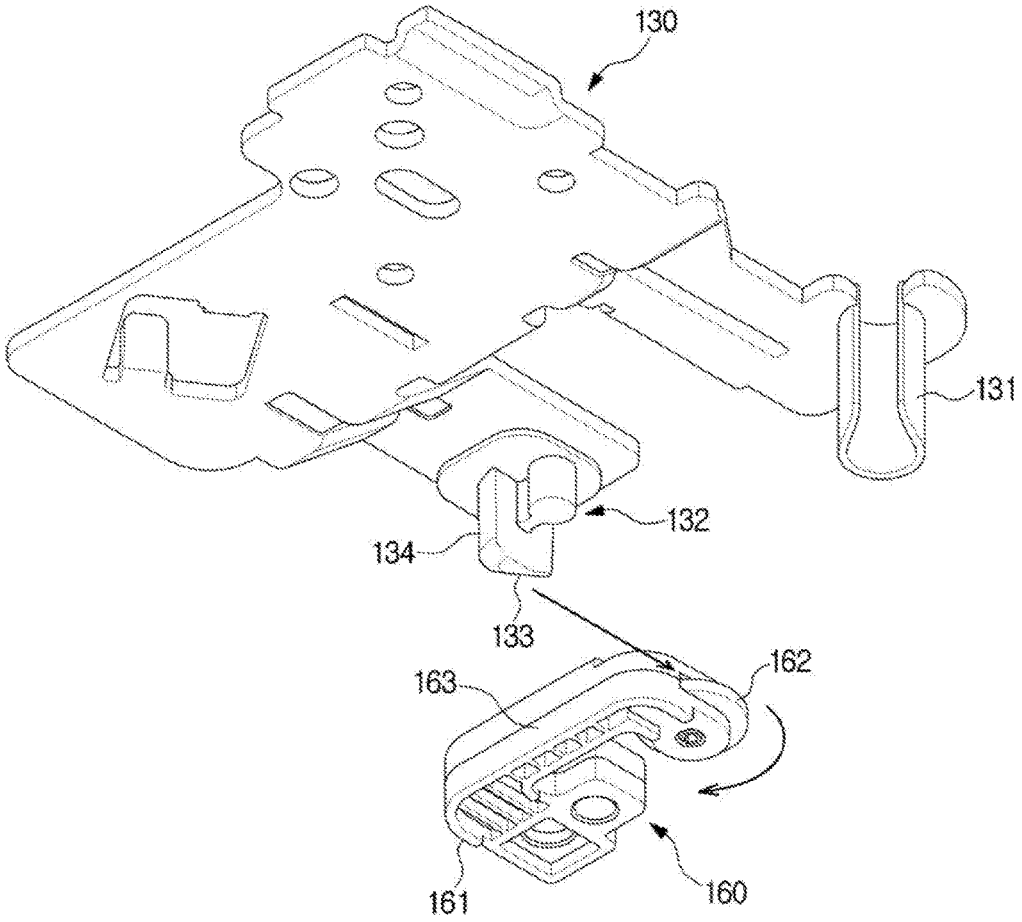
FIG. 7 is a perspective view illustrating the arrangement relationship between the first hinge unit and the automatic closing device in accordance with the embodiment of the present disclosure.
Figure 8:
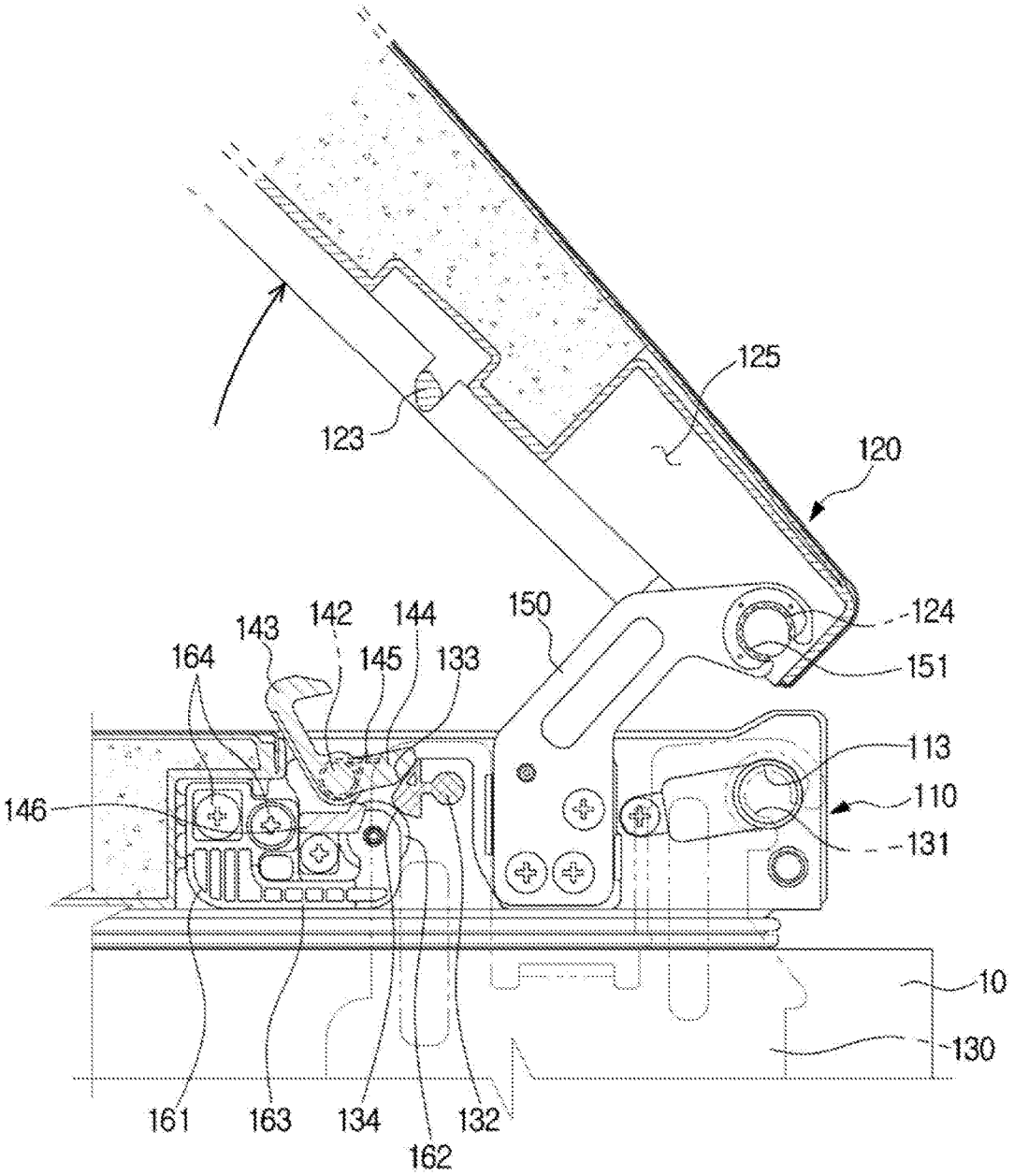
FIG. 8 is a view illustrating a state of the latch unit and the hinge unit when the first door is closed and only the second door of the refrigerator is opened in accordance with the embodiment of the present disclosure.
Figure 9:
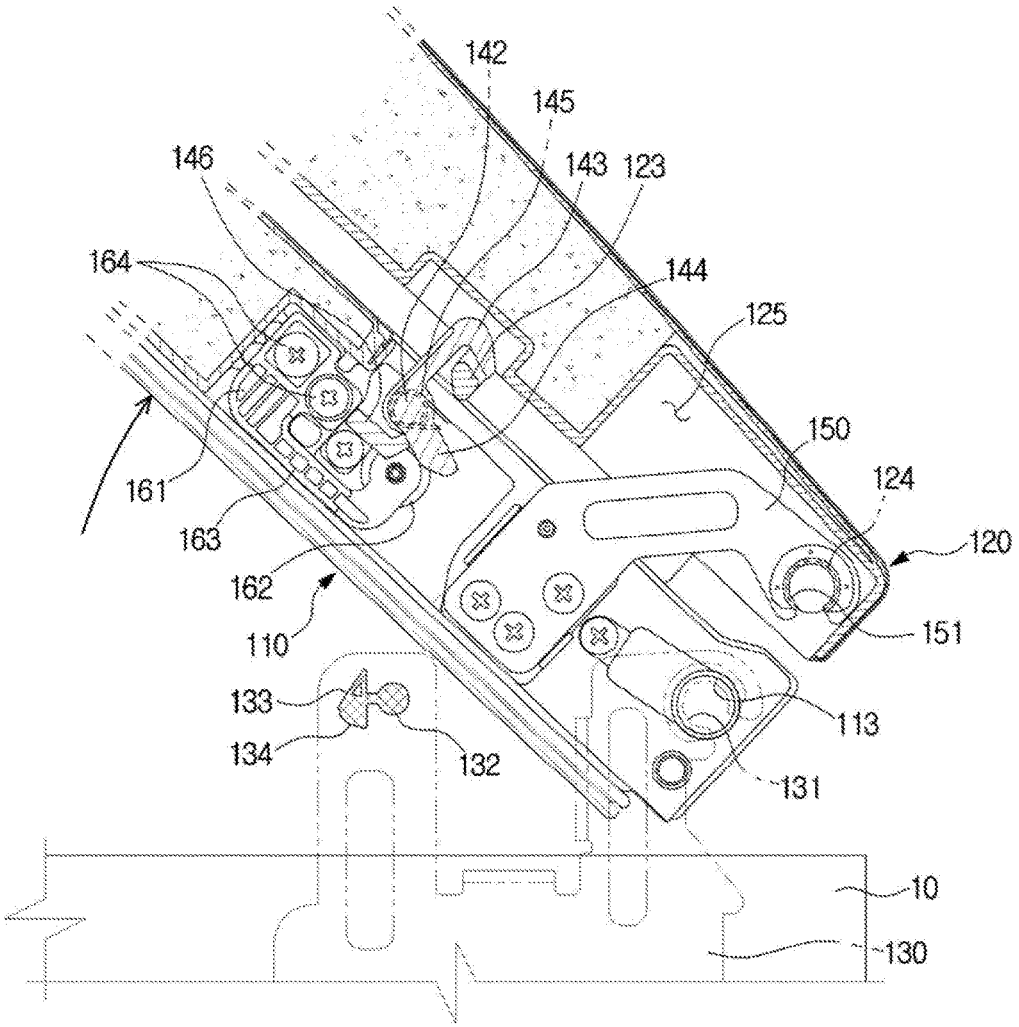
FIG. 9 is a view illustrating a state of the latch unit and the hinge unit when both of the first door and the second door of the refrigerator are opened in accordance with the embodiment of the present disclosure.

FIG. 4 is an exploded perspective view illustrating a latch unit and a hinge unit in accordance with the embodiment of the present disclosure. FIG. 5 is a view illustrating a state of the latch unit and the hinge unit when the first door and the second door of the refrigerator are closed in accordance with the embodiment of the present disclosure. FIG. 6 is a perspective view illustrating the arrangement relationship between the first hinge unit and the latch unit in accordance with the embodiment of the present disclosure. FIG. 7 is a perspective view illustrating the arrangement relationship between the first hinge unit and the automatic closing device in accordance with the embodiment of the present disclosure. FIG. 8 is a view illustrating a state of the latch unit and the hinge unit when the first door is closed and only the second door of the refrigerator is opened in accordance with the embodiment of the present disclosure. FIG. 9 is a view illustrating a state of the latch unit and the hinge unit when both of the first door and the second door of the refrigerator are opened in accordance with the embodiment of the present disclosure.

A part of the first hinge unit 130 may be fixed to the body 10 to support the rotation of the first door 110. For this, the first hinge unit 130 may include a first rotating shaft 131 rotatably inserted into the first hinge hole 113 of the first door 110. According to this configuration, the first door 110 may rotate about the body 10 with the first rotating shaft 131 as a rotation axis.

The first hinge unit 130 may include a push portion 132 configured to operate the latch unit 140, which is described later, by selectively making contact with the latch unit 140 and by pressing the latch unit 140, according to the rotation of the first door 110. The push portion 132 may be provided adjacent to the first rotating shaft 131, and may include a first push surface 133 configured to press the latch unit 140 by selectively making contact with the latch unit 140 and a second push surface 134 configured to press the automatic closing device 160 by selectively making contact with the automatic closing device 160. That is, the push portion 132 may be formed in a way that a cross-section thereof has an approximately mushroom-shape. FIG. 4 illustrates that the push portion 132 is detachably coupled to the first hinge unit 130, but is not limited thereto. Therefore, the push portion 132 may be integrally formed with the first hinge unit 130.

The push portion 132 may be disposed such that the push portion 132 is separated from the latch unit 140 and the automatic closing device 160 when the first door 110 opens the storage compartment 20 and the push portion 132 presses the latch unit 140 and the automatic closing device 160 by making contact with the latch unit 140 and the automatic closing device 160 when the first door 110 closes the storage compartment 20.

The first push surface 133 may be formed to face the second door 120 and the second push surface 134 may be formed to face the body 10. That is, the push portion 132 of the first hinge unit 130 may include a portion having an approximately triangular section. According to this configuration, the first push surface 133 may press the latch unit 140 to the front side in which the second door 120 is provided, and the second push surface 134 may press the automatic closing device 160 to the side of the body 10.

Referring to FIGS. 4 to 6, the latch unit 140 may be provided on the first door 110 and may include a latch lever 141 and a torsion member 145. The latch unit 140 may be configured to connect and fix the first door 110 to the second door 120 to each other when the first door 110 opens the storage compartment 20, and configured to release a connection between the first door 110 and the second door 120 when the first door 110 closes the storage compartment 20.

The latch lever 141 may be rotatably coupled to the first door 110 and selectively connect or disconnect the first door 110 to the second door 120. The latch lever 141 may include a rotation portion 142 rotatably coupled to the first door 110, the first connecting portion 143 selectively connected to the second door 120 and a power transmission part 144 selectively pressed by the push portion 132.

One end of the rotation portion 142 may be rotatably coupled to a latch fixing portion 114 of the first door 110, and the other end of the rotation portion 142 may be rotatably coupled to a latch bracket 146, described later. According to the configuration, the rotation portion 142 may be rotatable, but its position may be fixed.

The first connecting portion 143 may extend from the rotation portion 142 toward the second door 120 to be selectively connected to the second door 120. The first connecting portion 143 may be formed in an annular shape to be connected to the second connecting portion 123 of the second door 120, thereby fixing the first door 110 to the second door 120 to each other. However, the configurations of the first connecting portion 143 and the second connecting portion 123 are not limited thereto, and any configuration may be possible as long as the first door 110 and the second door 120 can be fixed to each other. In addition, the second connecting portion 123 may be integrally injection molded with the second door 120, or may be formed separately from the second door 120.

The power transmission part 144 may extend from the rotation portion 142 to a direction that is different direction from the first connecting portion 143, and according to the embodiment of FIG. 3, the power transmission part 144 may extend in an approximately 90° direction. Accordingly, a cross section of the latch unit 140 may have an approximately letter "L" shape. Since the power transmission part 144 is required to be selectively pressed by the push portion 132, the power transmission part 144 may be disposed in a position interfering with the push portion 132 when the first door 110 is closed.

One end of the torsion member 145 may be fixed to the first door 110 and the other end, which is opposite to the one end, may be fixed to the latch unit 140. Particularly, the other end of the torsion member 145 may be fixed to the power transmission part 144 of the latch unit 140.

The torsion member 145 may apply the torque to the latch lever 141 so that the latch lever 141 rotates in a direction in which the latch lever 141 is connected to the second door 120. The torsion member 145 may be provided to rotate the latch unit 140 in a direction in which the first connecting portion 143 and the second connecting portion 123 are connected to each other. That is, the direction of the torque of the torsion member 145 may be opposite to a direction in which the push portion 132 rotates the latch unit 140 by pressing the power transmission part 144.

The torsion member 145 may be set such that its rotational force is smaller than the force that the latch lever 141 receives from the push portion 132 of the first hinge unit 130 when the latch lever 141 and the push portion 132 of the first hinge unit 130 are in contact with each other.

The torsion member 145 may be a spring. The torsion member 145 may be provided to surround the rotation portion 142.

The latch bracket 146 may rotatably fix the latch lever 141 to the first door 110 so that the latch lever 141 is not separated from the first door 110.

The second hinge unit 150 may be provided in the first door 110. In at one end of the second hinge unit 150, the second rotating shaft 151 serving as a rotation center of the second door 120 may be provided, and the other end of the second hinge unit 150 that is opposite to the one end may be fixed to the first door 110. FIG. 4 illustrates that the second hinge unit 150 is installed on the first door 110, but is not limited thereto. Therefore, the second hinge unit 150 may be installed in the body 10 so that the second door 120 is rotatable about the body 10.

Referring to FIG. 7, when a user closes the first door 110 by a predetermined angle, the automatic closing device 160 may automatically performs a closing operation thereafter to allow the user to close the first door 110 with a relatively small force. The automatic closing device 160 may include an auto close lever 161 and a roller 162.

One end of the auto close lever 161 may be fixed to the first door 110 through a screw 164 and the roller 162 may rotatably coupled to the other end of the auto close lever 161 that is opposite to the one end. The auto close lever 161 may be formed of an elastic material and thus the auto close lever 161 may include a bending portion 163 configured to be bent when the roller 162 makes contact with the push portion 132. When the roller 162 performs a rolling operation from the first push surface 133 to the second push surface 134 of the push portion 132 or from the second push surface 134 to the first push surface 133, the bending portion 163 may be bent to allow the roller 162 to pass through the push portion 132.

The roller 162 may be rotatably coupled to one end of the auto close lever 161 and may perform the rolling operation on the first push surface 133 and the second push surface 134 of the push portion 132. When the first door 110 is closed, the roller 162 may make contact with the second push surface 134 and then pressed by the second push surface 134 in the direction of the body 10. That is, the push portion 132 may press the roller 162 in the direction in which the first door 110 is closed. As the roller 162 is pressed toward the body 10, the first door 110 may be pressed toward the body 10 and the first door 110 may close the storage compartment 20 more tightly.

Hereinafter an operation of the refrigerator 1 according to the embodiment of the present disclosure will be described with reference to FIGS. 5, 8 and 9.

Referring to FIG. 5, when both of the first door 110 and the second door 120 are closed, the latch unit 140 may be pressed in the direction of the second door 120 by the first push surface 133 of the push portion 132 of the first hinge unit 130. Accordingly, the latch lever 142 of the latch unit may rotate counterclockwise to release the connection the first door 110 and the second door 120. That is, the first connecting portion 143 may be separated from the second connecting portion 123.

When both of the first door 110 and the second door 120 are closed, the roller 162 of the auto close device 160 may be pressed in the direction of the body 10 by the second push surface 134 of the push portion 132 of the first hinge unit 130. Accordingly, the first door 110 in which the auto close device 160 is installed may be pressed toward the body 10 and thus the first door 110 may close the storage compartment 20 more tightly.

Referring to FIG. 8, a user may insert food into or withdraw food from the door shelf 102 provided on the second door 120 by only opening the second door 120, as illustrated in FIG. 3. At this time, the user may open the second door 120 by holding the second door handle 121. Accordingly, the second door 120 may rotate with respect to the second rotating shaft 151 as the rotation axis by being supported by the second hinge unit 150. In this case, since the latch unit 140 releases the connection between the first door 110 and the second door 120 as described above, the refrigerator according to the embodiment of the present disclosure may prevent a malfunction in advance, wherein the malfunction represents that the first door 110 is opened together with the second door 120 when opening the second door 120. In addition, according to the refrigerator according to the embodiment of the present disclosure, it may be possible to improve the user convenience since the malfunction of the first door 110 is prevented in advance by a simple operation of opening and closing of the second door 120 without an additional operation to release the connection between the first door 110 and the second door 120.

Referring to FIG. 9, a user may insert food into or withdraw food from the storage compartment 20 by opening both of the first door 110 and the second door 120, as illustrated in FIG. 2. At this time, the user may open both of the first door 110 and the second door 120 by holding the first door handle 111. Accordingly, the first door 110 may rotate with respect to the first rotating shaft 131 as the rotation axis by being supported by the first hinge unit 130. In this time, as the first door 110 is opened, the latch lever 141 may be separated from the push portion 132 and thus the push portion 132, which has been pressing the latch lever 141, may not press the latch lever 141 anymore. The latch lever 141 may rotate clockwise by the torque of the torsion member 145 to connect and fix the first door 110 to the second door 120 each other. That is, the first connecting portion 143 of the latch lever 141 may be locked and fixed to the second connecting portion 123 of the second door 120.

Therefore, according to the refrigerator according to the embodiment, when the first door 110 and the second door 120 are opened together, it may be possible to connect and fix the first door 110 to the second door 120 each other so that the first door 110 and the second door 120 are not separated from each other, and thus it may be possible to minimize the inconvenience when a user uses the door unit 100. In addition, according to the refrigerator according to the embodiment, since it may be possible to connect and fix the first door 110 to the second door 120 each other by only opening the first door 110 without an additional operation that is to connect and fix the first door 110 to the second door 120 each other, it may be easy to use.

When the first door 110 is opened together, the roller 162 of the automatic closing device 160 may sequentially roll the second push surface 134 and the first push surface 133 and thus the roller 162 may be separated from the push portion 132. On the other hand, when the first door 110 is closed, the roller 162 of the automatic closing device 160 may sequentially roll the first push surface 133 and the second push surface 134 and thus the roller 162 may be pressed by the push portion 132.

Particularly, when the first door 110 is closed, the roller 162 of the automatic closing device 160 may be pressed by the push portion 132 from when the roller 162 makes contact with the second push surface 134 after passing through the first push surface 133. Therefore, a user may be required to apply a force until the first door 110 passes through the first push surface 133 and after that time, the push portion 132 may close the first door 110. Accordingly, the user may close the first door 110 with a relatively small force.

As described above, according to the embodiment of the present disclosure, the first hinge unit 130 of the refrigerator 1 may guide the rotation of the first door 110, selectively connect and disconnect between the first door 110 and the second door 120, and allow the first door 110 to close the storage compartment 20 tightly by pressing the automatic closing device 160. As mentioned above, according to the refrigerator 1 according to the embodiment, by using the typical first hinge unit 130, it may be possible to operate the latch unit 140 configured to selectively connect and disconnect between the first door 110 and the second door 120, as well as supporting the rotation of the first door 110, and thus it may be possible to have a relatively simple structure. In addition, it may be possible to reduce the material cost since the number of parts is reduced.

Figure 10:
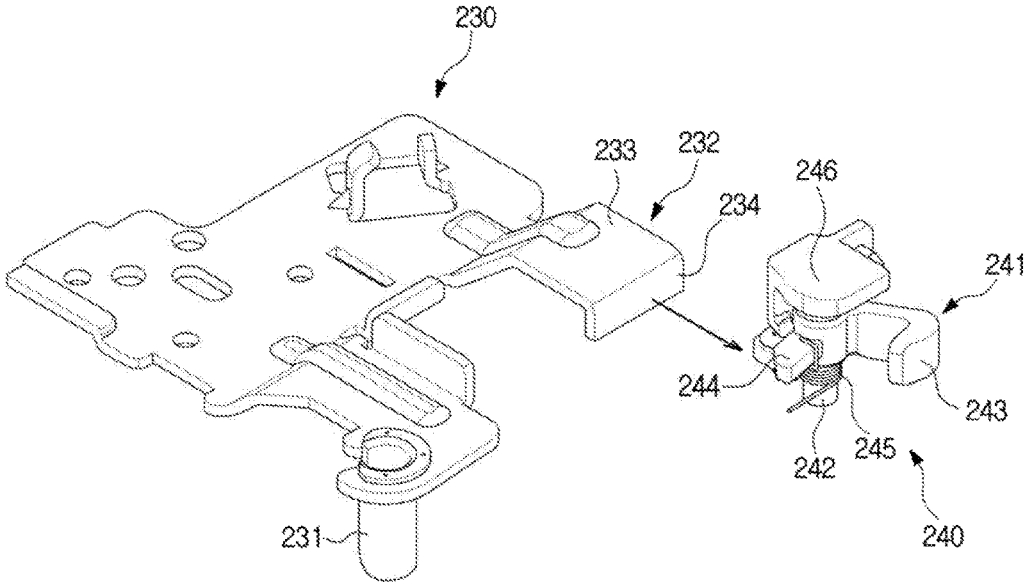
FIG. 10 is a perspective view illustrating a first hinge unit and a latch unit of a refrigerator according to another embodiment of the present disclosure.

FIG. 10 is a perspective view illustrating a first hinge unit 230 and a latch unit 240 of a refrigerator according to another embodiment of the present disclosure.

The first hinge unit 230 and the latch unit 240 of the refrigerator according to another embodiment will be described with reference to FIG. 10. A description of the same parts as those shown in the above will be omitted.

According to another embodiment of the present disclosure, the first hinge unit 230 may support the rotation of a first door 100 while one portion of the first hinge unit 230 is fixed to the body 10. For this, the first hinge unit 230 may include a first rotating shaft 231 rotatably inserted into a first hinge hole 113 of the first door 110. According to this configuration, the first door 110 may rotate about the body 10, with the first rotating shaft 231 as the rotational shaft.

The first hinge unit 230 may include a push portion 232 configured to press the latch unit 240 described later, by selectively making contact with the latch unit 240. The push portion 232 may be provided adjacent to the first rotating shaft 231, and the push portion 232 may include an extending portion 233 extending from the body 10, and a push surface 234 pressing the latch unit 240 by selectively making contact with the latch unit 240.

The push surface 234 may be formed such that an end portion of the extending portion 233 is bent. The push surface 234 may be formed to face the second door 120 while being formed in a position configured to press a power transmission part 244 of the latch unit 240. According to the configuration, the push surface 234 may rotate a latch lever 241 of the latch unit 240 by pressing the latch unit 240 to the front side in which the second door 120 is provided.

The latch unit 240 may be provided in the first door 110 and the latch unit 240 may include the latch lever 241 and a torsion member 245.

The latch lever 241 may selectively connect or disconnect the first door 110 to the second door 120 while rotating about the first door 110. The latch lever 241 may include a rotation portion 242 rotatably coupled to the first door 110, a first connecting portion 243 selectively connected to the second door 120 and the power transmission part 244 selectively pressed by the push surface 234.

One end of the rotation portion 242 may be rotatably coupled to a latch fixing portion 114 of the first door 110, and the other end of the rotation portion 242 may be rotatably coupled to a latch bracket 246.

The first connecting portion 243 may extend from the rotation portion 242 toward the second door 120 to be selectively connected to the second door 120. The first connecting portion 243 may be formed in an annular shape to be connected to the second connecting portion 123 of the second door 120, thereby fixing the first door 110 to the second door 120 each other.

The power transmission part 244 may extend from the rotation portion 242 to a direction that is different direction from the first connecting portion 243. Since the power transmission part 244 is required to be selectively pressed by the push surface 234, the power transmission part 244 may be disposed in a position interfering with the push surface 234 when the first door 110 is closed.

One end of the torsion member 245 may be fixed to the first door 110 and the other end, which is opposite to the one end, of the torsion member 245 may be fixed to the latch unit 240. The direction of the torque of the torsion member 245 may be opposite to a direction in which the push surface 234 rotates the latch unit 240 by pressing the power transmission part 244.

The latch bracket 246 may rotatably fix the latch lever 241 to the first door 110 so that the latch lever 241 is not separated from the first door 110.

Figure 11:
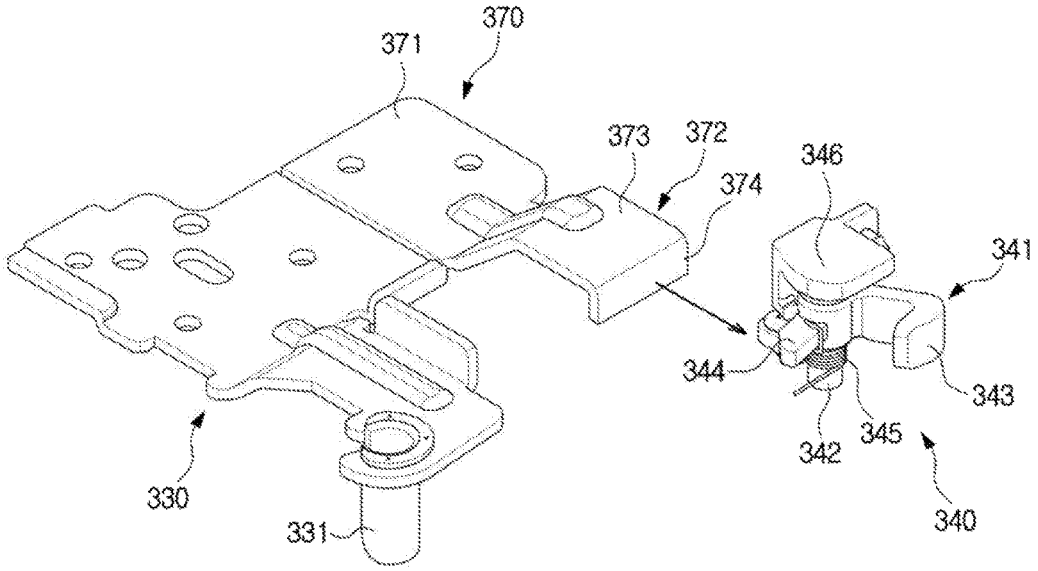
FIG. 11 is a perspective view illustrating a first hinge unit and a latch unit of a refrigerator according to another embodiment of the present disclosure.

FIG. 11 is a perspective view illustrating a first hinge unit and a latch unit of a refrigerator according to another embodiment of the present disclosure.

A first hinge unit 330 and a latch unit 340 of the refrigerator according to another embodiment will be described with reference to FIG. 11. A description of the same parts as those shown in the above will be omitted.

According to another embodiment of the present disclosure, the first hinge unit 330 may support the rotation of a first door 100 while one portion of the first hinge unit 330 is fixed to the body 10. For this, the first hinge unit 330 may include a first rotating shaft 331 rotatably inserted into a first hinge hole 113 of the first door 110.

According to another embodiment, the refrigerator may include a push member 370 provided adjacent to the first hinge unit 330. The push member 370 may include a fixing portion 371 fixed to the body 10, and a push portion 372 configured to selectively press the latch unit 340. The push member 370 may be formed in a position configured to selectively press the power transmission part 344 of the latch unit 340 according to the rotation of the first door 110.

The push portion 372 may include an extending portion 373 extending from the fixing portion 371 to the second door 120, and a push surface 374 pressing the latch unit 340 by selectively making contact with the latch unit 340.

The push surface 374 may be formed such that an end portion of the extending portion 373 is bent.

The latch unit 340 may be provided in the first door 110 and the latch unit 340 may include a latch lever 341 and a torsion member 345.

The latch lever 341 may selectively connect or disconnect the first door 110 to the second door 120 while rotating about the first door 110. The latch lever 341 may include a rotation portion 342 rotatably coupled to the first door 110, a first connecting portion 343 selectively connected to the second door 120 and the power transmission part 344 selectively pressed by the push surface 374.

One end of the rotation portion 342 may be rotatably coupled to a latch fixing portion 114 of the first door 110, and the other end of the rotation portion 342 may be rotatably coupled to a latch bracket 346.

The first connecting portion 343 may extend from the rotation portion 342 toward the second door 120 to be selectively connected to the second door 120.

The power transmission part 344 may extend from the rotation portion 342 to a direction that is different direction from the first connecting portion 343. Since the power transmission part 344 is required to be selectively pressed by the push surface 374, the power transmission part 344 may be disposed in a position interfering with the push surface 374 when the first door 110 is closed.

One end of the torsion member 345 may be fixed to the first door 110 and the other end, which is opposite to the one end, of the torsion member 345 may be fixed to the latch unit 340. The direction of the torque of the torsion member 345 may be opposite to a direction in which the push surface 374 rotates the latch unit 340 by pressing the power transmission part 344.

The latch bracket 346 may rotatably fix the latch lever 341 to the first door 110 so that the latch lever 341 is not separated from the first door 110.

As is apparent from the above description, according to the proposed refrigerator, it may be possible to secure the safety of use by preventing the first door and the second door from being separated from each other when the first door and the second door are opened together.

In addition, it may be possible to selectively fix a first door to a second door and release the fixation of the first door and the second door by using a relatively simple configuration and thus it may be possible to reduce the material cost since the number of parts is reduced.

It may be possible to maximize the space utilization by disposing a latch unit in a dead space that is adjacent to a hinge unit, and it may be possible to maintain a high level of appearance quality without a separate cover covering the latch unit.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a body provided with a storage compartment;

a door unit provided with a first door provided with an opening and rotatably coupled to the body to open or close to cause the storage compartment of the body to open or close, respectively, and a second door provided in front of the first door and configured to open or close to cause the opening of the first door to open or close, respectively;

a latch unit provided in the door unit and configured to selectively couple the second door to the first door; and a first hinge unit on the body to support a rotation of the first door and provided with a portion configured to selectively operate the latch unit according to the rotation of the first door to cause the latch unit to couple and decouple the second door to the first door based on the rotation of the first door wherein the latch unit includes a latch lever rotatably coupled to the first door and couplable to the second door, and a torsion member configured to apply a torque to the latch lever so that the latch lever rotates toward a direction in which the latch lever is couplable to the second door.

2. The refrigerator of claim 1, wherein to selectively couple the second door to the first door, the latch unit is configured to couple the second door to the first door when the first door opens the storage compartment, and decouple the first door and the second door when the first door closes the storage compartment.

3. The refrigerator of claim 1, wherein the latch lever includes a rotation portion rotatably coupled to the first door, a first connecting portion configured to extend from the rotation portion in a first direction and couplable to the second door, and a power transmission part configured to extend from the rotation portion in a second direction that is different from the first direction, and the portion of the first hinge unit selectively presses power transmission part to selectively operate the latch lever of the latch unit.

4. The refrigerator of claim 3, wherein one end portion of the torsion member is fixed to the first door, and the other end portion of the torsion member, which is opposite to the one end portion, is fixed to the power transmission part.

5. The refrigerator of claim 3, wherein the second door includes a second connecting portion provided on a rear surface thereof and configured to be selectively couplable to the first connecting portion.

6. The refrigerator of claim 5, wherein the second connecting portion is detachably provided on the second door.

7. The refrigerator of claim 1, wherein the latch unit further includes a latch bracket configured to rotatably fix the latch lever to the first door.

8. The refrigerator of claim 1, wherein the latch unit is provided in the first door.

9. The refrigerator of claim 1, wherein the portion is detachably provided in the first hinge unit.

10. The refrigerator of claim 1, further comprising:

a second hinge unit provided on the first door to guide a rotation of the second door.

11. A refrigerator comprising:

a body provided with a storage compartment;

a door unit provided with a first door provided with an opening and rotatably coupled to the body to open or close to cause the storage compartment of the body to open or close, respectively, and a second door provided in front of the first door and configured to open or close to cause the opening of the first door to open or close, respectively;

a latch unit provided in the door unit and configured to selectively couple the second door to the first door; and a first hinge unit on the body to support a rotation of the first door and provided with a portion configured to selectively operate the latch unit according to the rotation of the first door to cause the latch unit to couple and decouple the second door to the first door based on the rotation of the first door, wherein the first door includes an auto close lever having one end portion thereof fixed to the first door and having an elasticity, and a roller rotatably installed in the other end portion that is opposite to the one end portion of the auto close lever.

12. The refrigerator of claim 11, wherein the portion selectively makes contact with the roller and presses the roller toward a direction in which the first door is closed, when the first door is closed.

13. The refrigerator of claim 11, wherein when the first door is closed, the portion pushes and rotates the latch unit to decouple the first door and the second door while the portion also presses the roller.

14. The refrigerator of claim 11, wherein the portion includes a first push surface and a second push surface, and when the first door is closed, the first push surface presses the roller and the second push surface pushes and rotates the latch unit.

15. A refrigerator comprising:

a body provided with a storage compartment;

a first door provided with an opening and configured to be rotatably coupled to the body to open or close to cause the storage compartment of the body to open or close, respectively;

a second door configured to be rotatably provided in the same direction as the first door to open or close to cause the opening of the first door to open or close, respectively;

a latch unit provided on the first door and configured to selectively couple the second door to the first door;

a first hinge unit provided on the body to rotatably support the first door and configured to selectively operate the latch unit according to a rotation of the first door to cause the latch unit to couple and decouple the second door to the first door based on the rotation of the first door; and an automatic closing device provided in the first door and configured to be pressable by the first hinge unit, and when the first door is closed by an angle the first hinge unit presses the automatic closing device and causes the automatic closing device to automatically perform a closing operation thereafter, wherein the first hinge unit is disposed to be apart from the latch unit and the automatic closing device, when the first door opens the storage compartment, and the first hinge unit is disposed to apply a force to the latch unit and the automatic closing device by making contact with the latch unit and the automatic closing device, when the first door closes the storage compartment.

16. The refrigerator of claim 15, wherein the latch unit includes a latch lever rotatably coupled to the first door and couplable to the second door, and a torsion member configured to apply a torque to the latch lever so that the latch lever rotates towards a direction in which the latch lever is couplable to the second door, wherein the torque of the torsion member is set to be smaller than the force received by the latch lever from the first hinge unit when the latch lever and the first hinge unit are in contact with each other.

17. The refrigerator of claim 16, wherein the latch lever includes a power transmission part configured to be selectively pressable by the first hinge unit, and the first hinge unit includes a portion having a first push surface selectively in contact with the power transmission part and a second push surface selectively in contact with the automatic closing device.

18. The refrigerator of claim 15, wherein the automatic closing device includes an auto close lever having one end portion thereof fixed to the first door and having an elasticity, and a roller rotatably installed on the other end portion of the automatic closing device that is opposite to the one end portion of the automatic closing device, wherein the roller is selectively in contact with one part of the first hinge unit.

* * * * *